US011668446B2

(12) United States Patent
Berrezai et al.

(10) Patent No.: US 11,668,446 B2
(45) Date of Patent: Jun. 6, 2023

(54) VEHICLE LIGHT MODULE COMPRISING A LOCATING PIN WITH A FLEXIBLE PART AND A RIGID PART

(71) Applicant: VALEO VISION, Bobigny (FR)

(72) Inventors: Francois Berrezai, Bobigny (FR); Jean-Marc Gressot, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 17/276,880

(22) PCT Filed: Sep. 17, 2019

(86) PCT No.: PCT/EP2019/074908

§ 371 (c)(1),
(2) Date: Mar. 17, 2021

(87) PCT Pub. No.: WO2020/064441

PCT Pub. Date: Apr. 2, 2020

(65) Prior Publication Data

US 2022/0034467 A1 Feb. 3, 2022

(30) Foreign Application Priority Data

Sep. 28, 2018 (FR) ..... 1858941

(51) Int. Cl.
*F21S 41/29* (2018.01)
*F21S 41/265* (2018.01)
(Continued)

(52) U.S. Cl.
CPC ..... *F21S 41/295* (2018.01); *F21S 41/147* (2018.01); *F21S 41/265* (2018.01); *F21S 41/27* (2018.01);
(Continued)

(58) Field of Classification Search
CPC ..... F21S 41/29; F21S 41/322; F21S 43/315; F21V 19/0035; F21V 19/004;
(Continued)

(56) References Cited

U.S. PATENT DOCUMENTS 5,379,972 A 1/1995 Decore et al.
6,939,029 B1 * 9/2005 Stahel ..... B60Q 1/2696 362/545
(Continued)

FOREIGN PATENT DOCUMENTS

CN 107525005 A * 12/2017 ..... F21S 41/148
CN 107525005 A 2/2018
(Continued)

OTHER PUBLICATIONS

European Patent Office, International Search Report (w/English Translation) and Written Opinion of the International Application No. PCT/EP2019/074908, dated Oct. 16, 2019.
(Continued)

*Primary Examiner* — Colin J Cattanach
(74) *Attorney, Agent, or Firm* — Valeo Vision

(57) ABSTRACT

The present invention relates to a motor vehicle's light module for lighting or signaling device purposes and includes at least one light source mounted on a support, an optical unit that engages the light source that forms a light beam and a locating system, which includes at least one locating pin inserted into a locating orifice. The support contains at least one locating pin and the locating orifice while the optical unit has the other locating pin and locating orifice. The locating pins include two facing parts where one of the parts is identified as the rigid part, and the other of the parts is identified as the flexible part, where the one part is more rigid than the other of the two facing parts.

14 Claims, 4 Drawing Sheets

(51) Int. Cl.

| | |
|---|---|
| ***F21S 41/147*** | (2018.01) |
| ***F21S 41/27*** | (2018.01) |
| ***F21S 41/32*** | (2018.01) |
| ***F21S 41/40*** | (2018.01) |
| ***F21S 41/24*** | (2018.01) |
| ***F21S 41/20*** | (2018.01) |
| ***F21V 17/16*** | (2006.01) |

(52) U.S. Cl.
CPC ..... *F21S 41/322* (2018.01); *F21S 41/40* (2018.01); *F21S 41/24* (2018.01); *F21S 41/285* (2018.01); *F21S 41/29* (2018.01); *F21V 17/16* (2013.01); *F21V 17/164* (2013.01)

(58) Field of Classification Search
CPC .... F21V 19/0045; F21V 17/16; F21V 17/164; B60Q 1/263
See application file for complete search history.

(56) References Cited

U.S. PATENT DOCUMENTS

| | | | | |
|---|---|---|---|---|
| 7,703,951 | B2 * | 4/2010 | Piepgras | F21K 9/00 362/373 |
| 10,408,248 | B1 * | 9/2019 | Safry | F16B 5/0628 |
| 2005/0169002 | A1 | 8/2005 | Steen et al. | |
| 2006/0262545 | A1 * | 11/2006 | Piepgras | F21K 9/00 362/373 |
| 2008/0106897 | A1 * | 5/2008 | Yoon | G02B 3/0056 359/628 |
| 2009/0175044 | A1 * | 7/2009 | Veenstra | F21S 43/14 362/368 |
| 2009/0303726 | A1 | 12/2009 | Borgschulte et al. | |
| 2012/0081619 | A1 * | 4/2012 | Shimizu | G02F 1/133603 348/790 |
| 2015/0062948 | A1 | 3/2015 | Otsubo | |
| 2015/0093179 | A1 | 4/2015 | Morris et al. | |
| 2015/0138759 | A1 * | 5/2015 | Nameda | G02F 1/133603 362/97.2 |
| 2017/0241625 | A1 | 8/2017 | Trottier et al. | |
| 2018/0058651 | A1 * | 3/2018 | Gromfeld | F21S 41/24 |
| 2018/0259147 | A1 | 9/2018 | Pfaff | |

FOREIGN PATENT DOCUMENTS

| | | | | |
|---|---|---|---|---|
| CN | 107654957 | A | 2/2018 | |
| CN | 207674347 | U * | 7/2018 | F21S 41/24 |
| EP | 2693106 | A2 | 2/2014 | |
| EP | 2846078 | A1 | 11/2015 | |
| EP | 2966344 | A1 | 1/2016 | |
| EP | 3372890 | A1 | 9/2018 | |
| FR | 2698738 | A1 | 6/1994 | |
| JP | S4984971 | U | 7/1974 | |
| JP | H04348893 | A | 12/1992 | |
| JP | H09201003 | A | 7/1997 | |
| JP | 2001110207 | A | 4/2001 | |
| JP | 5143964 | B1 | 2/2013 | |
| JP | 2013524426 | A | 6/2013 | |
| JP | 2015079614 | A | 4/2015 | |
| JP | 2015220033 | A | 12/2015 | |
| KR | 20160051352 | A | 5/2016 | |
| WO | 2017179465 | A1 | 10/2017 | |

OTHER PUBLICATIONS

Korean Intellectual Property Office, Office Action (with English translation) of corresponding Korean Application No. 2021-7011935, dated Oct. 21, 2022.

China National Intellectual Property Administration, Office Action (with English translation) of corresponding Chinese Application No. 201980062429.4, dated May 27, 2022.

Japan Patent Office, Office Action (with English translation) of corresponding Japanese Application No. 2021-517380, dated May 6, 2022.

China National Intellectual Property Administration, Second Office Action (with English Summary) of corresponding Chinese Application No. 201980062429.4, dated Feb. 27, 2023.

* cited by examiner

VEHICLE LIGHT MODULE COMPRISING A LOCATING PIN WITH A FLEXIBLE PART AND A RIGID PART

CROSS-REFERENCE TO RELATED APPLICATIONS

This is a 371 application (submitted under 35 U.S.C. § 371) of International Application No. PCT/EP2019/074908 (WO2020064441) filed on Sep. 17, 2019, which claims the priority date benefit of French Application No. FR1858941 filed on Sep. 28, 2018, the disclosures of which are hereby incorporated by reference in their entirety.

TECHNICAL FIELD

The present invention relates to the field of light devices, particularly for motor vehicles, in which a light source is positioned relative to an optical unit.

In particular, the invention relates to a light module, wherein this positioning is ensured by means for locating the support of this source engaging with means for locating the optical unit. More particularly, these locating means are pins and orifices into which these pins are inserted.

"Location" is given to mean locators that make it possible to guarantee a given positioning in at least one direction in space.

Location in three directions orthogonal to each other is known by inserting pins into orifices in order to ensure accurate positioning. As the positioning is in these three directions, only one position is theoretically possible. As a result, in the absence of play, the support must be positioned accurately before mounting on the optical unit if the support is to be assembled.

However, the light source support and the optical unit are produced separately, sometimes by different manufacturers, and therefore have certain manufacturing tolerances, in particular in terms of the positioning of the holes and orifices. If there is a slight misalignment, there is a risk that assembly will be difficult, or even impossible.

BACKGROUND

However, the light source support and the optical unit are produced separately, sometimes by different manufacturers, and therefore have certain manufacturing tolerances, in particular in terms of the positioning of the holes and orifices. If there is a slight misalignment, there is a risk that assembly will be difficult, or even impossible.

To avoid this, a known solution is to produce the locating pin with a sufficiently smaller diameter than the corresponding orifice, so that play is present around the pin, between it and the edges of the orifice.

Although this makes it possible to guarantee mounting, one drawback is that this play remains once the support has been assembled on the optical part. The result is that accuracy is lost in the positioning of the light source relative to the optical unit, in particular when the vehicle is in use. As a result, there is also a loss of quality of the beam emitted by the light module.

SUMMARY

One technical problem addressed by the present invention is therefore improving the accuracy of the positioning of the light source relative to the optical unit, while guaranteeing assembly of the support on the optical unit.

To this end, a first object of the invention is a light module for a motor vehicle lighting and/or signaling device, comprising:

at least one light source mounted on a support, an optical unit for engaging with the light source to form a light beam, a locating system comprising at least one locating pin inserted into a locating orifice, the support being provided with one of the locating pin and the locating orifice, and the optical unit being provided with the other of the locating pin and the locating orifice;

the or at least one of the locating pins comprising two facing parts, one of the parts, known as the rigid part, being more rigid than the other of the parts, known as the flexible part.

Thus, when the support is assembled on the optical unit, if the orifice and the locating pin with which it engages are misaligned, the flexible part can deform to allow the insertion of this pin into this orifice, the rigid part guiding the pin into the orifice. The flexible part thus allows a small range of movement on assembly, making it possible to guarantee easier assembly. Once inserted, the flexible part is in contact with the orifice, thus making it possible to limit or even eliminate play. As a result, positioning is more accurate and less subject to variations when the module is assembled on the lighting and/or signaling device or when the vehicle is in use.

The optical part according to the invention can optionally comprise one or more of the following features:

the flexible part is elastic and arranged so that it presses the rigid part against an edge of the locating orifice; this makes it possible to completely eliminate play while ensuring a range of movement on assembly and more accurate positioning;

the or at least one of the locating pins is a split pin comprising a slot separating said two parts from each other; this is a simple way of producing a pin with two parts, in particular by moulding or machining;

the rigid part comprises a reinforcing protuberance, fixed to the portion of the optical unit from which the corresponding locating pin protrudes and arranged so that it opposes a force in a direction transverse to the slot, in particular perpendicular to the slot; the guidance by the rigid part is thus improved by reinforcing it;

the reinforcing protuberance has a first rigid bearing zone enabling location in a direction orthogonal to the support, in particular in a vertical direction; two functions are performed by the same element, thus simplifying the production of the locating system;

the light module comprises at least two split locating pins, the slots of which are aligned in an alignment direction; this enables simple location perpendicular to the alignment direction;

the light module comprises at least three locating pins, a third split locating pin being aligned at a distance from the alignment direction; isostatism in two orthogonal directions is thus ensured;

the third locating pin is also a split pin, the slot of which is oriented perpendicular to said alignment direction; the accuracy of the positioning is improved, while allowing a range of movement and simplifying assembly;

the flexible part of the or at least one of the locating pins is a leaf spring arranged so that the stress thereof increases as it gets closer to the rigid part; this is a simple way of pressing the rigid part against the edge of the orifice; this leaf spring can be an insert, in particular made from metal;

the or at least one of the locating pins is bi-material, in particular obtained by bi-injection, the rigid part being made from a first material and the flexible part being made from a second material; this is an alternative way of producing the two parts;

the second material is more flexible than the first material, and optionally elastic;

the first material is polycarbonate (PC) and the second material is silicone;

the light module comprises several locating pins; the positioning is improved;

the light module comprises at least three locating pins arranged so that isostatism is achieved in three directions that are transverse, in particular orthogonal, to each other; the positioning is further improved;

the rigid part comprises a first rigid bearing zone pressed against a portion of whichever of the optical unit and the support includes the corresponding locating orifice, this portion being separate from the edge or edges of this orifice; this makes it possible to achieve location in a separate direction from the locating direction between the rigid part and the edge of the orifice; in particular in the case of the protuberance, it can extend between the base and a vertex of this protuberance, this vertex comprising the first bearing zone;

the light module can comprise three locating pins each having a first bearing zone; the first three bearing zones thus define a locating plane, enabling location in a direction perpendicular to this plane;

the optical unit comprises one or a plurality of collimators, a cut-off member and an output member arranged so that they shape the light rays emitted by the light source so as to form a cut-off beam, the one-piece optical part comprising the collimator(s); in particular, the optical unit can comprise a one-piece optical part comprising one or a plurality of collimators, a cut-off member and an output member arranged so that they shape the light rays emitted by the light source so as to form a cut-off beam, in particular a low beam; the accuracy of positioning makes it possible to minimize the risks of stray rays, which is particularly important in the context of a cut-off beam and in particular with a one-piece part;

the locating pin(s) and/or the rigid part of the locating pin(s) are integrally formed with said one-piece optical part, the support comprising the locating orifice(s); accurate positioning of the support relative to the optical unit can thus be achieved;

the locating pin(s) are arranged around the collimator or plurality of collimators;

the support is a printed circuit board and has the locating orifice(s), the optical unit having the locating pin(s); the optical unit can for example comprise the one-piece optical part;

the light source is a light-emitting diode;

the locating orifices and/or the locating pins are arranged so that:

in a direction of displacement of the flexible part towards the rigid part, the locating pins have a first play with the edges of the corresponding locating orifices, in a direction transverse to this direction of displacement, the locating pins are either each in contact with the edges of the corresponding locating orifices, or have a second play with the edges of the corresponding locating orifices, the first play being greater than the second play;

in particular, in the case of split locating pins, the first play can be on each side of the lateral ends of the slot;

the locating orifice(s) is/are oblong; in particular, in the case of split locating pins, the locating orifice(s) can be wider in a direction parallel to the slot than in a direction transverse to it.

Another object of the invention is a vehicle lighting and/or signalling device comprising a light module according to the invention.

The invention also relates to a vehicle comprising a vehicle lighting and/or signalling device according to the invention, in particular connected to the electricity supply of the vehicle.

Unless otherwise stated, the terms "front, "rear", "top", "bottom", "transverse", "longitudinal", "horizontal" and any derivatives thereof, refer to the direction of emission of light out of the corresponding light module. Unless otherwise stated, the terms "upstream" and "downstream" refer to the direction of propagation of the light.

BRIEF DESCRIPTION OF THE DRAWINGS

Further features and advantages of the invention will become apparent on reading the detailed description of the following non-limiting embodiments, which will be more clearly understood with reference to the attached drawings, in which.

DETAILED DESCRIPTION

Figure 1:
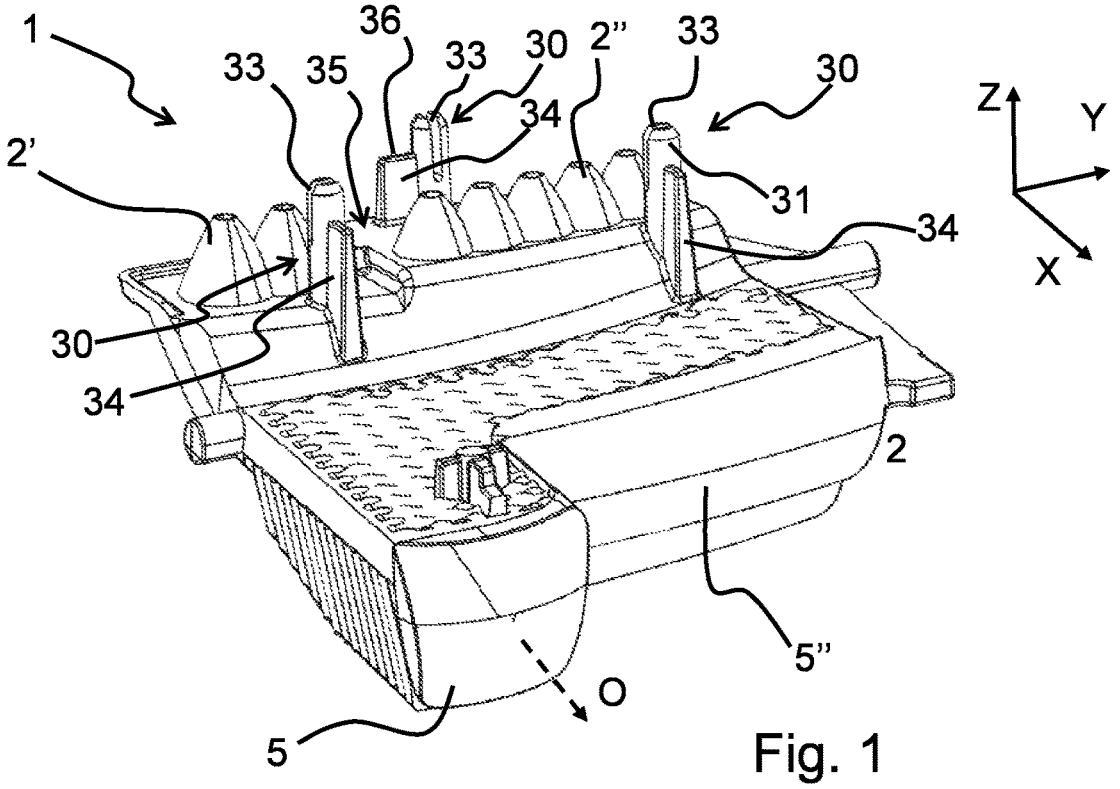
FIG. 1 is a top front perspective view of an optical part of an example of the light module according to the invention.
Figure 2:
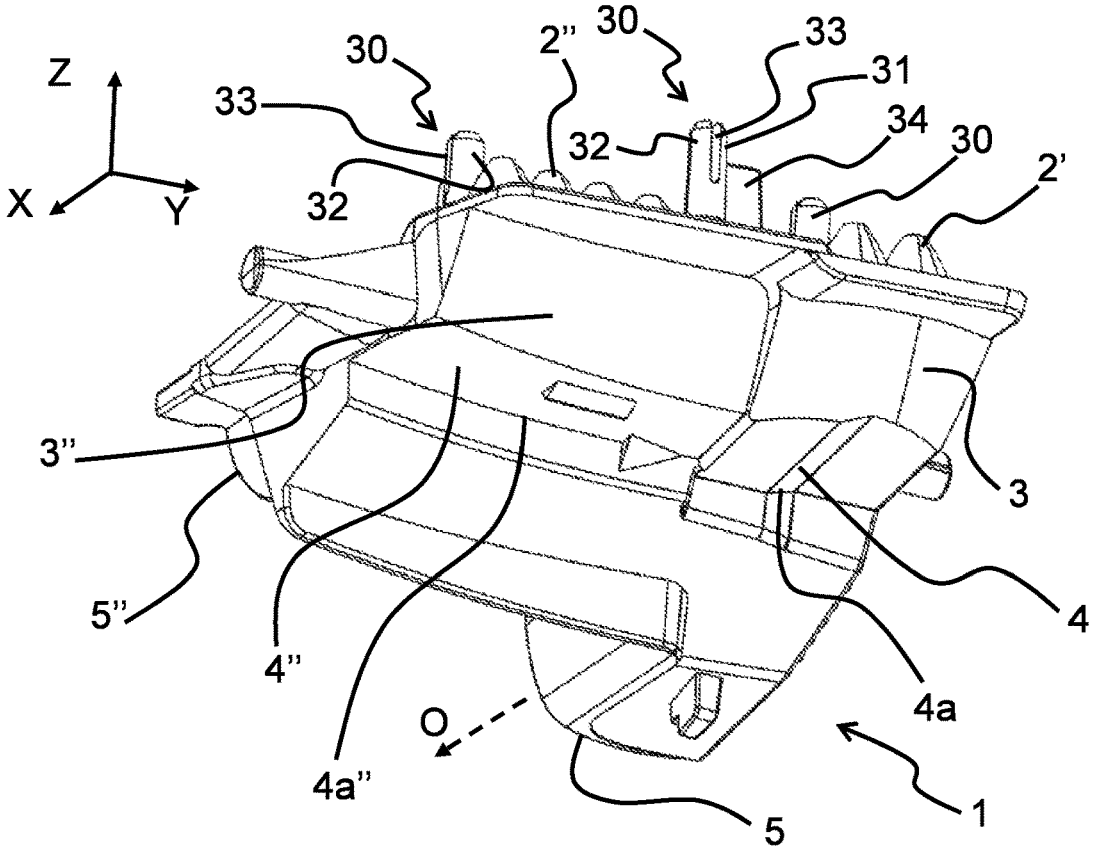
FIG. 2 is a bottom rear perspective view of the optical part in FIG. 1.
Figure 3:
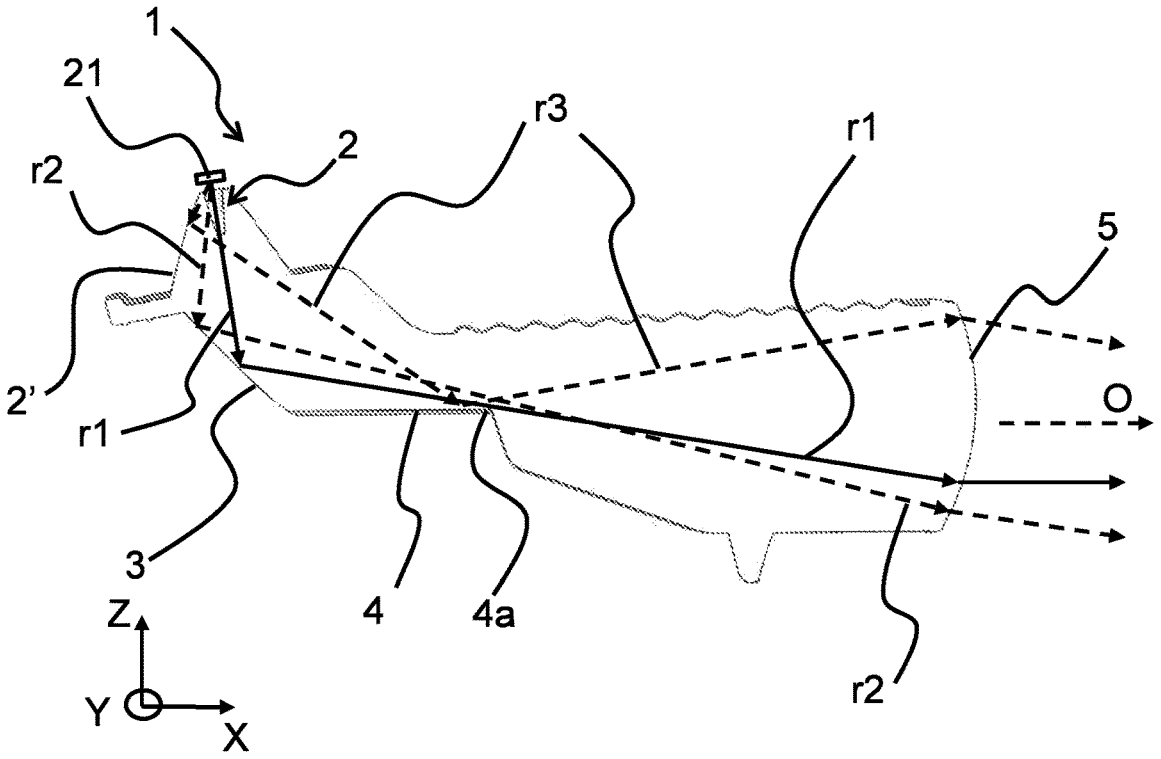
FIG. 3 is a longitudinal cross-section of the optical part in FIG. 1, in which a light source is also shown.

FIGS. 1 to 3 illustrate an example of an optical unit of a light module according to one embodiment of the invention. Here, this optical unit is a one-piece optical part 1.

In this example, the light module is a vehicle headlamp light module.

The optical part 1 comprises a first plurality of collimators 2' and a second plurality of collimators 2". Each of these collimators 2', 2" comprises an input refracting surface 2 for receiving the light rays r1, r2, r3 emitted by a light source 21, 22, here for being placed facing and close to the free end of the corresponding collimator 2', 2", on top and lighting downwards in this example.

In this example, the light source is a light-emitting diode, also known as an LED 21.

These light rays r1, r2, r3 enter the collimators 2', 2", and therefore the optical part 1, by refraction.

Here, the first plurality of collimators comprises two collimators 2', which are each optically coupled to a reflecting member 3, which is optically coupled to a cut-off member 4, in turn coupled to an output member 5. These different elements are therefore coupled together and arranged so that they shape the light rays emitted by the light sources 21 so as to form a cut-off beam.

Each collimator 2' is arranged to send, here by refraction and total internal reflection, the light rays r1, r2, r3 emitted by the LED 21, in a more focused beam, towards the reflecting member 3.

Here, this reflecting member 3 is a refracting surface arranged so that it reflects, by total internal reflection, these rays r1, r2, r3 towards the cut-off member 4, more particularly towards the edge 4*a* of this cut-off member 4. For example, the reflecting member 3 can reflect these rays r1, r2, r3 towards a focal zone arranged on this edge 4*a*.

These rays r1, r2, r3 pass over this edge 4*a* in three different ways, as will be explained below, and then reach the output member 5, here the output refracting surface 5 of the optical part 1. They then exit the optical part 1 by refraction through the output refracting surface 5.

This output refracting surface 5 is arranged so that it forms a member for projecting the image of the edge 4*a*.

Thus, the rays r1 that pass closest to the edge 4*a*, without meeting the surface 4*b* of the bender, in particular in a focal zone of the output refracting surface 5, are refracted by the output refracting surface 5 parallel to an optical axis O of the light module.

However, the rays r2 and r3 that pass above this edge 4*a* will be refracted downwards by the output refracting surface 5.

Some of these rays r2 refracted downwards are first reflected directly by the reflecting member 3 onto the output refracting surface 5, passing above the edge 4*a*. Other rays r3 refracted downwards are first reflected by the reflecting member 3 behind the edge 4*a*, and are therefore reflected by the bender 4, by total internal reflection, towards the output refracting surface 5, also passing above the edge 4*a*.

Most, or even all, of the rays r1, r2, r3 therefore contribute to the formation of the beam exiting the optical part 1. This beam is the light beam emitted by the optical module.

Figure 8:
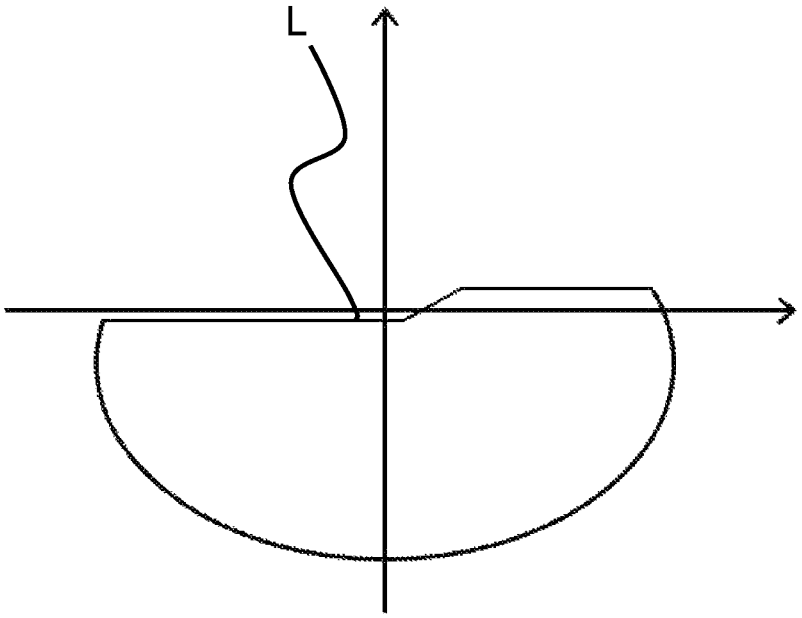
FIG. 8 shows a beam having an upper cut-off line.

In addition, this beam has an upper cut-off line L, as illustrated in FIG. 8. This cut-off line L corresponds to the image of the edge 4*a*, which therefore forms the cut-off edge of the bender 4, the rays being sent at the highest on the cut-off line (rays r1) or below (rays r2, r3).

Here, the beam is a central portion of a low beam. It can be observed that the edge 4*a* has an oblique portion and two horizontal portions on either side of this oblique portion, corresponding to the shape of the cut-off line L.

Here, the second plurality of collimators comprises five collimators 2" that are each optically coupled, upstream to downstream, to a reflecting member 3", a cut-off member 4" and an output member 5", arranged so that they shape the light rays emitted by the light source so as to form a horizontal cut-off beam, according to the same principle as described in FIG. 3. The difference is that here, the cut-off edge 4*a*" is in a horizontal plane.

The central portion and the horizontal cut-off beam are emitted at the same time so as to form a low beam.

The refracting surfaces forming the input refracting surface 2 of the collimators 2', 2", the reflecting members 3, 3", the benders 4, 4" forming the cut-off members and the output reflecting surfaces 5, 5" therefore make it possible, due to the arrangement thereof, to shape the beam so that it corresponds to a low beam. These refracting surfaces therefore form the active surfaces of the optical part 1.

The importance of the positioning of the LEDs 21, 22 relative to their respective collimators 2', 2" will therefore be understood. In the event of a positioning error, the rays r1, r2, r3 will not follow the path for which the optical part 1 was designed. There is therefore a risk that a beam that does not comply with what was desired will be obtained.

This is all the more important with the first plurality of collimators 2', in order to avoid as far as possible having rays above the cut-off line L, and therefore dazzling the drivers of vehicles in front or coming from the other direction.

To this end, the optical part 1 is provided with locating pins 30.

As illustrated in FIGS. 1 and 2 and 4 to 6, the locating pins 30 are three in number and comprise two facing parts:

a rigid part 31, a flexible part 32, in the sense that it is less rigid than the rigid part 31.

Here, the three locating pins 30 are split pins comprising a slot, not shown, separating these two parts 31, 32 from each other.

Each of these locating pins 30 protrudes, here upwards, from a portion of the optical part 1, this portion being referred to hereafter as the base 35.

Generally according to the invention, the rigid part 31 can, as it does here, have a reinforcing protuberance 34. This reinforcing protuberance 34 can extend between said base 35 and a vertex 36 of this protuberance 34.

This vertex 36 can, as it does here, form a first rigid bearing zone 36 enabling location in a direction orthogonal to the support, here in a vertical direction Z, as will be explained below.

Here, the first three rigid bearing zones 36, i.e. those of each locating pin 30, are flat and coplanar. They therefore form a locating plane passing through these bearing zones 36, thus enabling location according to a displacement in a direction perpendicular to this locating plane. Here, they therefore enable the location of a support in a vertical direction Z, when this support is mounted so as to rest against these bearing zones 36.

According to the invention, as they are here, the reinforcing protuberances 34 can be connected to the respective locating pins 30 along their entire length and thus stiffen the respective locating pins 30 in a movement going from the flexible part 32 towards the rigid part 31.

Figure 4:
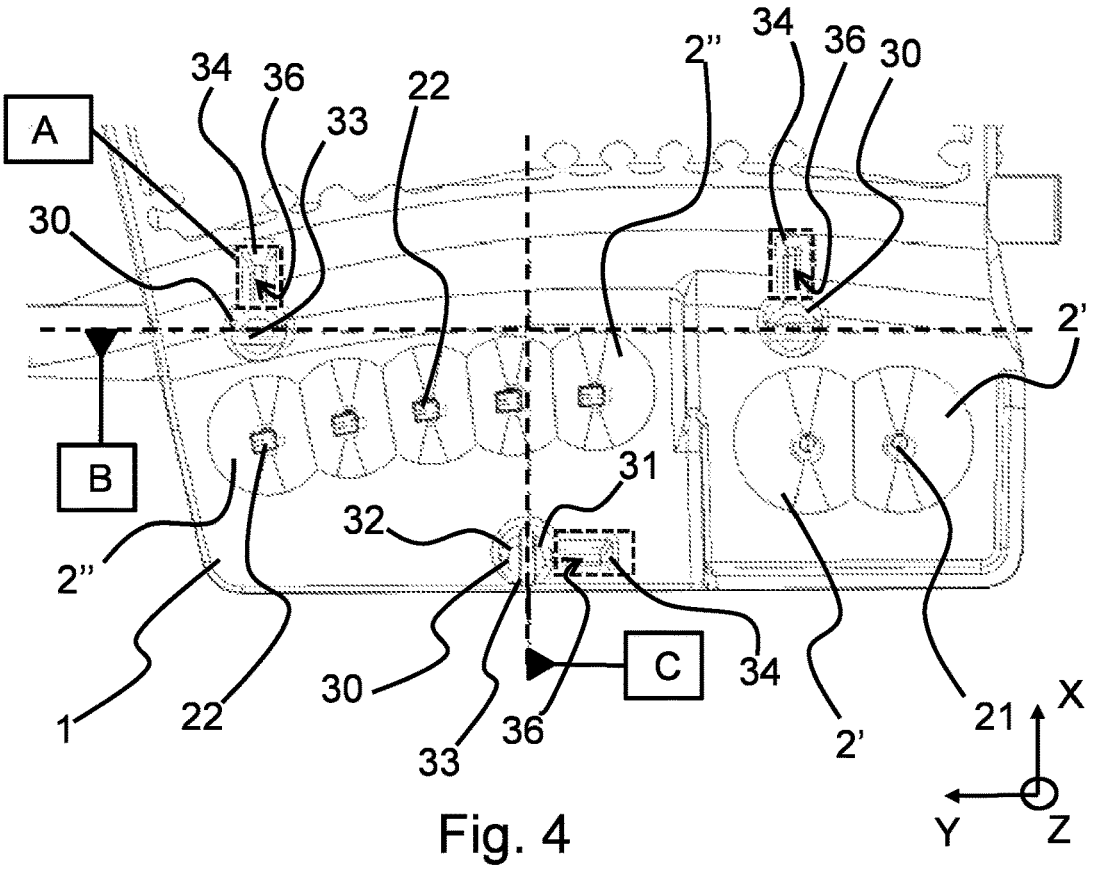
FIG. 4 is a top view of a rear part of the optical part in FIG. 1, in which the light sources are also shown.
Figure 5:
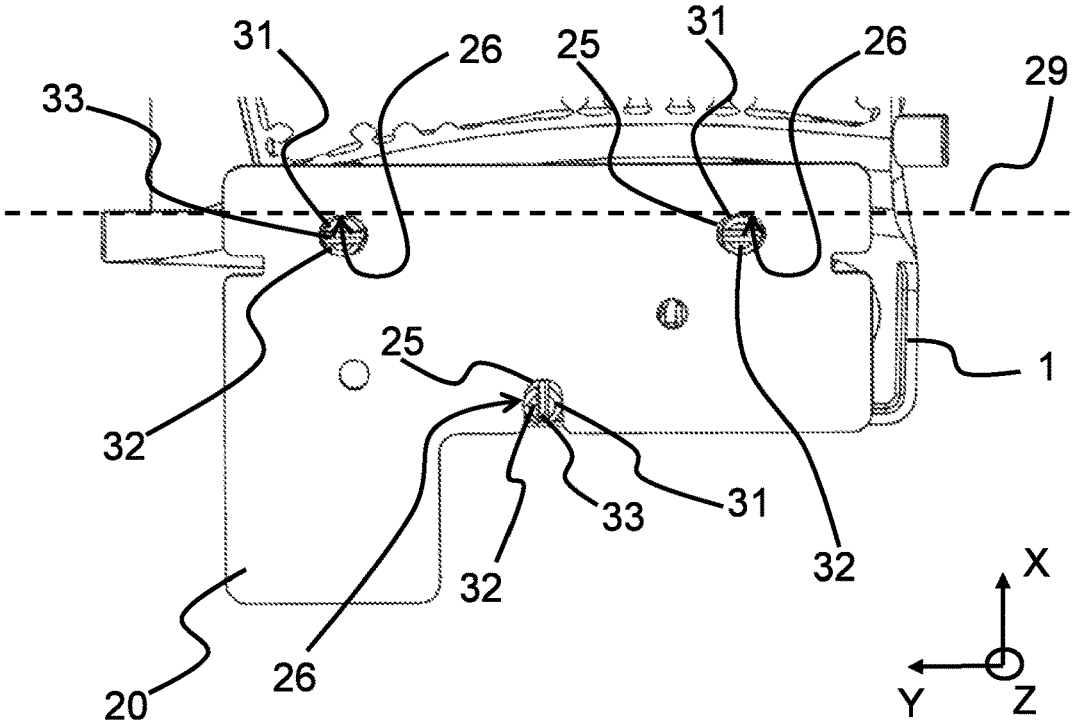
FIG. 5 shows a rear part of a light module with the optical part according to FIG. 4 and the mounted light source support.
Figure 6:
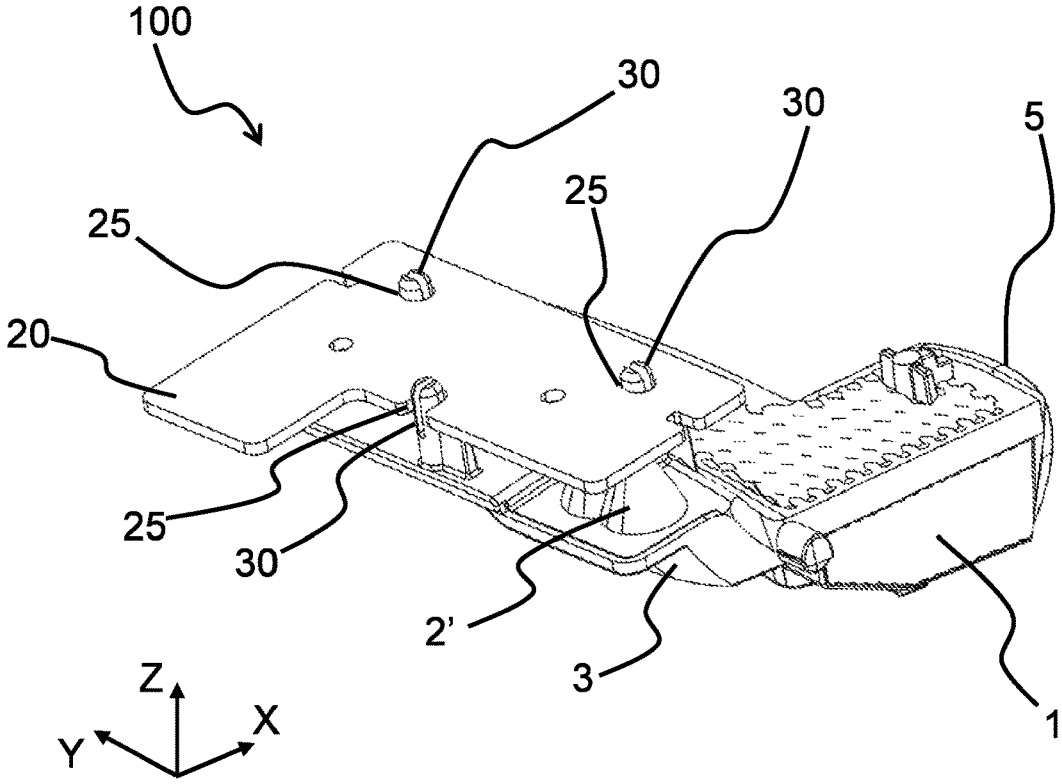
FIG. 6 is a top rear perspective view of the light module in FIG. 5.

As can be seen in FIGS. 4 to 6, these locating pins 30 form, with the locating orifices 25, a system for locating a support 20 of the light sources 21, 22 on the optical part 1, in order to position the LEDs 21, 22 correctly relative to the input refracting surface 2 and the collimators 2', 2".

Here, the locating pins 30 are integrally formed with the optical part 1, the support 20 comprising the locating orifices 25.

In this example, the support 20 is a printed circuit board, on which the LEDs 21, 22 are positioned and fixed. It is therefore easier to produce the locating orifices 25 on this board and produce the locating pins 30 on the optical part 1.

Nonetheless, according to other embodiments not shown, this could be reversed and the locating pins produced on the support and the locating orifices on a part of the optical unit. For example, such an arrangement could be applied if the support was a radiator and the optical part a reflector.

According to the invention, the flexible part 32 can be elastic. In this example, this is obtained by means of the slot 33.

The slot 33 enables the flexibility of the flexible part 32, in particular towards the rigid part 31.

The rigidity of the latter is increased by the reinforcing protuberance 34.

This arrangement and the effects thereof are explained below with reference to FIGS. 7*a* and 7*b*.

Figure 7A:
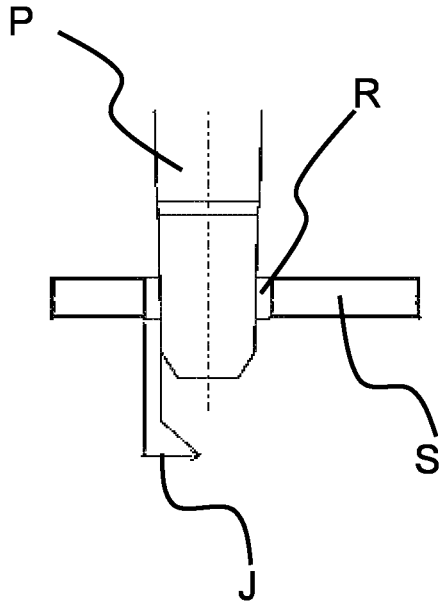
FIGS. 7*a* and 7*b* respectively show a locating pin according to the prior art and an example of a locating pin according to the invention.

FIG. 7*a* illustrates a locating pin P according to the prior art. It engages with a locating orifice R of a light source support S. To avoid the risk of non-assembly of the optical unit and this support, play J is provided between the lateral edges of the locating pin P and the edge of this locating orifice R.

Figure 7B:
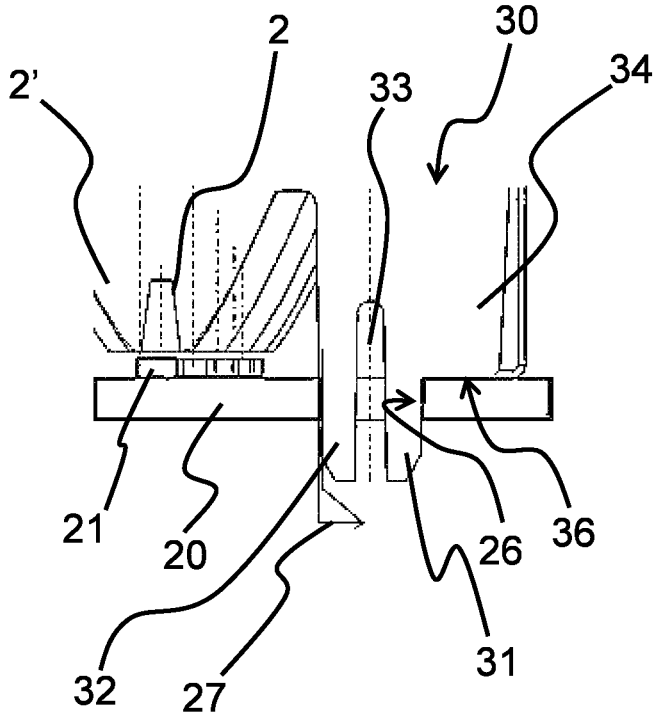

In FIG. 7*b*, which illustrates a locating pin 30, such as those of the optical part illustrated in FIGS. 1 to 6, the locating pin 30 is housed in the locating orifice 25 of the support 20, the rigid part 31 bearing against the edge 26 of the locating orifice 25.

According to the invention, as it is here, the slot 33 can be arranged so that it extends depthwise along a longitudinal axis of the locating pin 30. In particular, the slot 33 can extend through the locating orifice 25 and beyond the locating orifice 25 moving away from the free end of the locating pin 30.

During assembly, the flexibility of the flexible part 32 makes it possible for it to move closer to the rigid part 31. In the event that the locating pin and orifice 30, 25 are misaligned, this range of movement makes it possible for the flexible part 32 to bend into the slot 33, enabling the locating pin 30 to fit into the locating orifice 25.

Furthermore, the elasticity of this flexible part 32 will generate a return force, so that the flexible part 32 will exert push on the edge 26 of the locating orifice 25 and move the locating pin 30 towards the part of the edge that is facing the rigid part 31. This rigid part 31 thus ensures the accuracy of the location.

Here, it can be seen that the play 27 remaining after mounting is very small, more than eight times smaller than the play J of the prior art.

This play 27 can even be zero, in particular with the flexible part 32 forced against the edge of the orifice and exerting push, pressing the rigid part 31 against the edge 26 of the orifice 25.

In particular, as is the case here, this push is exerted in a direction transverse to the slot 33.

In addition, the support 20 is pushed in with its face holding the LEDs 21, 22 pressing against the first bearing zone 36. Thus, as illustrated in FIG. 7*b*, this first rigid bearing zone 36 is pressed against a portion of the support 20 adjacent to the edge 26 of the corresponding locating orifice 25.

In this example, the optical part 1 comprises three locating pins 30 engaging with three locating orifices 25, so that isostatism is achieved in three directions orthogonal to each other.

As can be seen in FIGS. 4 and 5, which here are top views of the module 100, the support 20 is resting on the first three bearing zones 36, which are coplanar, and are therefore contained in a plane A, horizontal here, symbolized by the dotted rectangles in FIG. 4. This enables the positioning of the support 20 in this plane A and therefore assembly with vertical location. This enables accurate positioning relative to a displacement in the vertical direction Z. In other words, during assembly, the first bearing zones 36 form a stop in the vertical direction Z.

Here, the slots 33 of the two front locating pins 30, arranged at the top in these figures, are aligned in an alignment direction B, here parallel to a transverse direction Y.

Here, the front locating orifices 25 are slightly oblong, so that these front locating pins 30 have play at each lateral end of their slots 33 and no play perpendicularly and on either side of them. Transverse play is thus allowed in this alignment direction B.

Furthermore, the range of movement of the corresponding flexible parts 32 enables less risky assembly and makes it possible to press the two rigid parts 31 against the edge 26 of the locating orifices 25, therefore along a locating line 29 parallel to the alignment direction B. There is therefore longitudinal positioning, i.e. longitudinal location, as the locating line 29 forms the recoil limit of the support 20 relative to the optical part 1.

The third locating pin 30, here at the rear, is at a distance from the alignment direction B, and therefore from the line passing through the slots 33 of the front locating pins 30.

This enables improved vertical bearing of the support 20.

In addition, the slot 33 of this rear locating pin 30 is arranged so that it is aligned with a longitudinal straight line C perpendicular to the alignment direction B.

Thus, the range of movement of the flexible part 32 of this rear locating pin 30 makes it possible to press the corresponding rigid part 31 against the edge of the locating orifice 25, and therefore at a point of this longitudinal straight line C. As the front locating pins 30 allow solely transverse play, i.e. parallel to the alignment direction B, this point thus forms a displacement limit for a transverse displacement of the support 20, and therefore forms a transverse locator between the optical part 1 and the support 20.

These three locating pins 30 alone therefore enable the location of the support 20 on the optical part 1 in the three orthogonal directions: longitudinal X, transverse Y and vertical Z.

It must be noted that the rear locating orifice 25 is open on the rear side so that it enables longitudinal play, so as to facilitate the range of movement of the flexible parts 32 of the front locating pins 30.

Here, the locating pins 30 are arranged around the pluralities of collimators 2', 2", or even adjacent to certain collimators 2', as can be seen in FIG. 7*b*.

It must be noted that according to a variant not shown, such isostatic location can be obtained with three locating pins, at least one of which differs from the previous locating pins 30 in that the flexible part differs in that it is formed by a leaf spring, in particular made from metal. This leaf can be driven or fitted into the locating pin, the leaf being able to be displaced towards the rigid part by being placed under elastic stress.

According to a variant not shown, such isostatic location can be obtained with three locating pins, at least one of which differs from the previous locating pins 30 in that the rigid part is made from a first material, in particular PC, and the flexible part is made from a second material, in particular silicone, thus enabling elastic deformation with increased stress when the flexible part is compressed towards the rigid part.

What is claimed is:

1. A light module of a motor vehicle lighting or signaling device, comprising: at least one light source mounted on a support; an optical unit that interfaces with the light source through the support that is configured to form a light beam; a locating system including a number of locating pins inserted into a number of respective locating orifices such that the respective number of locating pins that mate with the respective number of locating orifices are provided clearance play between the respective locating pins and the respective locating orifices upon interface of the support with the optical unit; the support being provided with said number of locating pins or said number of locating orifices, and the optical unit being provided with said number of counterpart locating orifices or said number of counterpart locating pins; wherein said number of the locating pins each includes opposing face parts protruding from a common raised cylindrical portion of the support or the optical unit and separated by a slot therebetween, where one of said opposing face parts is a rigid part and the other of said opposing face parts is a flexible part, the rigid part being more stiffened than the flexible part; wherein the flexible part is elastic and arranged so that the flexible part is configured to depress toward the rigid part upon interface with of the rigid part against an edge of a respective locating orifice; wherein the light module includes at least three locating pins, one of the three locating pins being aligned at a distance from and perpendicular to an alignment direction (B).

2. The Light module according to claim 1, wherein the rigid part includes a reinforcing protuberance that is fixed to the portion of the optical unit from which a corresponding locating pin protrudes and is arranged so that the rigid part opposes a force in a transverse direction to the slot.

3. The Light module according to claim 2, wherein the reinforcing protuberance has a first rigid bearing zone enabling location in a direction orthogonal to the support in a vertical direction.

4. The Light module according to claim 3, wherein the respective slots of at least two locating pins are aligned in the alignment direction (B).

5. The Light module according to claim 1, wherein the flexible part of at least one of the locating pins is a leaf spring arranged so that the stress thereof increases as it gets closer to the rigid part.

6. The Light module according to claim 1, wherein at least one of the locating pins is bi-material, obtained by bi-injection, the rigid part being made from a first material and the flexible part being made from a second material.

7. The Light module according to claim 1, wherein the rigid part comprises a first rigid bearing zone pressed against a portion of the optical unit and the support that includes a corresponding locating orifice, the portion being separate from edges of the corresponding locating orifice.

8. The Light module according to claim 1, wherein the optical unit includes a one-piece optical unit that includes a number of collimators, a cut-off member and an output member are arranged so that a number of light rays emitted by the corresponding light source are shaped so as to form a cut-off beam.

9. A Light module according to claim 8, wherein said locating pins or the rigid part of said locating pins is integrally formed with the one-piece optical part and wherein the support includes said locating orifices.

10. A Light module according to claim 9, wherein said locating pins are arranged around a number of collimators.

11. A Light module according to claim 1, wherein said locating orifices or said locating pins are arranged so that:

the locating pins have a first clearance play with edges of corresponding locating orifices in a direction of displacement of the flexible part towards the rigid part, the locating pins are either each in contact with the edges of the corresponding locating orifices in a direction transverse to this direction of displacement, or have a second clearance play with edges of the corresponding locating orifices, where the first clearance play is greater than the second clearance play.

12. A Vehicle lighting or signaling device comprising a light module according to claim 1.

13. The Light module according to claim 1, wherein a portion of the locating orifices are shaped slightly oblong such that the respective number of locating pins that mate with the portion of the locating orifices are provided clearance play between the respective locating pins and locating orifices upon interface of the support with the optical unit.

14. A light module of a Motor vehicle lighting or signaling device, comprising: at least one light source mounted on a support; an optical unit that interfaces with the light source through the support that is configured to form a light beam; a locating system including a number of locating pins inserted into a number of respective locating orifices such that the respective number of locating pins with the number of respective locating orifices mate together with clearance play between each other upon interface of the support with the optical unit; the support being provided with at least one of said locating pins or at least one of said locating orifices, and the optical unit being provided with at least one said number of counterpart locating orifices or at least one said number of counterpart locating pins; wherein said number of the locating pins includes opposing face parts protruding from a raised cylindrical portion of the support or the optical unit, the opposing face parts separated by a slot therebetween, where the opposing face parts are configured from a rigid part and a flexible part, where the rigid part is configured to be stiffer than the flexible part; wherein the light module includes at least two locating pins, the respective slots of which are in an alignment with a direction (B), a third locating pin being aligned in a perpendicular direction from the alignment with the direction (B).

* * * * *